US007052782B2

(12) United States Patent
Bossmann et al.

(10) Patent No.: US 7,052,782 B2
(45) Date of Patent: May 30, 2006

(54) HIGH-TEMPERATURE PROTECTION LAYER

(75) Inventors: Hans-Peter Bossmann, Lauchringen (DE); Dietrich Eckardt, Ennetbaden (CH); Klaus Erich Schneider, Kuessaberg (DE); Christoph Toennes, Brugg (CH)

(73) Assignee: ALSTOM Technology Ltd., Baden (CH)

( * ) Notice: Subject to any disclaimer, the term of this patent is extended or adjusted under 35 U.S.C. 154(b) by 0 days.

(21) Appl. No.: 10/893,326

(22) Filed: Jul. 19, 2004

(65) Prior Publication Data

US 2005/0042474 A1 Feb. 24, 2005

Related U.S. Application Data

(63) Continuation of application No. PCT/CH03/00023, filed on Jan. 16, 2003.

(30) Foreign Application Priority Data

Jan. 18, 2002 (DE) ..... 102 02 012

(51) Int. Cl.
*B32B 15/04* (2006.01)
*C22C 19/03* (2006.01)

(52) U.S. Cl. ..... 428/680; 428/679; 428/632; 428/332; 420/446; 420/445; 420/455; 420/460; 420/447; 420/449

(58) Field of Classification Search ..... 428/632, 428/633, 679, 680, 567, 332, 610; 420/443, 420/445, 455, 460, 447, 449; 148/428
See application file for complete search history.

(56) References Cited

U.S. PATENT DOCUMENTS

| | | | | |
|---|---|---|---|---|
| 3,620,693 | A | 11/1971 | Sama et al. | |
| 3,754,903 | A | 8/1973 | Goward et al. | |
| 3,837,894 | A | 9/1974 | Tucker et al. | |
| 4,013,424 | A | 3/1977 | Wildgoose et al. | |
| 4,022,587 | A | 5/1977 | Wlodek | |
| 4,088,479 | A | 5/1978 | Spengler | |
| 4,095,003 | A | 6/1978 | Weatherly et al. | |
| 4,477,538 | A | 10/1984 | Clarke | |
| 4,537,744 | A | 8/1985 | Gross et al. | |
| 4,743,514 | A | 5/1988 | Strangman et al. | |
| 4,973,445 | A | 11/1990 | Singheiser | |
| 6,458,318 | B1 * | 10/2002 | Nishiyama et al. | 420/448 |
| 6,623,869 | B1 * | 9/2003 | Nishiyama et al. | 428/685 |

FOREIGN PATENT DOCUMENTS

| | | |
|---|---|---|
| EP | 1 001 055 A1 | 5/2000 |
| JP | 53 85736 | 7/1978 |
| WO | 99/02745 | 1/1999 |
| WO | 03/060194 A1 | 7/2003 |

OTHER PUBLICATIONS

Search Report from PCT/CH 03/00023 (Apr. 1, 2003).
IPER from PCT/CH 03/00023 (Jun. 12, 2003).
IPER from PCT/CH 03/00023 (Jun. 12, 2003, English Translation).

* cited by examiner (Continued)

*Primary Examiner*—Jennifer McNeil
(74) *Attorney, Agent, or Firm*—Cermak & Kenealy, LLP; Adam J. Cermak

(57) ABSTRACT

A high-temperature protection layer contains (% by weight) 23 to 27% Cr, 4 to 7% Al, 0.1 to 3% Si, 0.1 to 3% Ta, 0.2 to 2% Y, 0.001 to 0.01% B, 0.001 to 0.01% Mg and 0.001 to 0.01% Ca, remainder Ni and inevitable impurities. Optionally, the Al content is in a range from over 5 up to 6% by weight.

11 Claims, 1 Drawing Sheet

HIGH-TEMPERATURE PROTECTION LAYER

This application is a Continuation of, and claims priority under 35 U.S.C. § 120 to, International application number PCT/CH03/00023, filed 16 Jan. 2003, and claims priority under 35 U.S.C. § 119 to German application number 102 02 012.4, filed 18 Jan. 2002, the entireties of both of which are incorporated by reference herein.

BACKGROUND OF THE INVENTION

1. Field of the Invention

The invention relates to a high-temperature protection layer.

2. Brief Description of the Related Art

High-temperature protection layers of this type are used in particular where the base material of components made from heat-resistant steels and/or alloys used at temperatures over 600° C. is to be protected.

These high-temperature protection layers are intended to slow down or completely suppress the action of high-temperature corrosion, in particular caused by sulfur, oil ashes, oxygen, alkaline-earth metals and vanadium. High-temperature protection layers of this type are formed in such a way that they can be applied direct to the base material of the component that is to be protected.

High-temperature protection layers are of particular importance for components of gas turbines. They are applied in particular to rotor blades and guide vanes and to heat-accumulation segments of gas turbines.

It is preferable to use an austenitic material based on nickel, cobalt or iron to produce these components. In particular nickel superalloys are used as base material in the production of gas turbine components.

Hitherto, it has been customary to provide components intended for gas turbines with protection layers which are formed by alloys whose main constituents are nickel, chromium, aluminum and yttrium. High-temperature protection layers of this type have a matrix in which an aluminum-containing phase is embedded.

Most of the coatings used for high-temperature applications originate from the NiCrAlY, CoCrAlY or NiCoCrAlY families. The layers differ by virtue of the concentration of the "family members" nickel, cobalt, chromium, aluminum and yttrium and by virtue of further elements being added. The composition of the layer is the crucial factor in determining the performance at high temperatures in an oxidizing and/or corrosive atmosphere, in the event of temperature changes and under mechanical loading. Moreover, the composition of the layer determines the materials costs and production costs. Many known layers have excellent properties only for some of the aspects. Although in widespread use throughout the world, both corrosion resistance and the costs are adversely affected by the addition of cobalt, as our own investigations have determined.

Documents JP-A-53 085736, U.S. Pat. No. 3,620,693, U.S. Pat. No. 4,477,538, U.S. Pat. No. 4,537,744, U.S. Pat. No. 3,754,903, U.S. Pat. No. 4,013,424, U.S. Pat. No. 4,022,587 and U.S. Pat. No. 4,743,514 have disclosed numerous alloys belonging to the "cobalt-free NiCrAlY family". Thermodynamic modeling of the phase composition of these alloys for the temperature range from 800° C. to 1050° C. has shown that the specified compositions lead to microstructures with undesirable phases or thermally activated phase transitions, specifically σ-and/or β-NiAl, in disadvantageously high proportions by volume.

SUMMARY OF THE INVENTION

Proceeding from the prior art mentioned in the introduction, the invention is based on the object of providing a high-temperature protection layer which is inexpensive, oxidation-resistant, corrosion-resistant and able to withstand temperature changes.

The inventive composition of this alloy includes (% by weight) 23 to 27% chromium, 4 to 7% aluminum, 0.1 to 3% silicon, 0.1 to 3% tantalum, 0.2 to 2% yttrium, 0.001 to 0.01% boron, 0.001 to 0.01% magnesium and 0.001 to 0.01% calcium. All the weight details are based on the total weight of the corresponding alloy. The remainder of the alloy consists of nickel and inevitable impurities. It is preferable for the Al content to be in a range from over 5 up to 6% by weight.

The protection layer according to the invention is a NiCrAlY alloy. Its resistance to oxidation and corrosion is significantly improved compared to the known high-temperature protection layers. With the high-temperature protection layer according to the invention, it can be concluded that at high temperatures (over 800° C. depending on the particular form) includes aluminum-containing γ and γ' phases in a proportion by volume of at least 50%, allowing the formation of a protection layer which contains aluminum oxide, and at low and medium temperatures (below 900° C. depending on the particular form) it includes more than 5% of chromium-containing α-Cr phases (indicated in FIG. 1 as BCC), allowing the formation of a protection layer which contains chromium oxide.

If silicon and boron are added to the alloy which forms the high-temperature protection layer, the bonding of the covering layer, which contains aluminum oxide, at high temperatures is improved, which significantly increases the protection of the high-temperature protection layer and the component beneath it. The addition of magnesium and calcium in particular binds the impurities which are naturally present during production, thereby increasing the resistance to corrosion at temperatures below 850–950° C. The quantitative ratio of chromium to aluminum is restricted to 3.6 to 6.5, in order to prevent the formation of brittle β phases. The quantitative ratio of nickel to chromium is limited to 2.3 to 3.0, in order to prevent brittle a phases, which improves the ability to withstand temperature changes. The secure and stable bonding of the protection layer and its covering layer in the event of frequent temperature changes is achieved by the yttrium content which is specifically stipulated for the alloy.

The composition selected here includes little if any a phase and/or β-NiAl phase by volume (FIG. 1), and consequently significant benefits are to be expected in the event of fluctuating temperature loads. The comparison alloy from FIG. 2 shows a similar composition with respect to some elements, but on account of the differences in other elements has a very different microstructure, which our experience has shown will not be sufficiently able to withstand temperature changes when used in a turbine and, moreover, cannot be used on account of incipient melting at temperatures over 900° C.

The production-related, inherent sulfur impurity, which is typically present in concentrations of less than 10 ppm but in some cases may amount to up to 50 ppm, leads to a reduced resistance to oxidation and corrosion. According to the invention, the trace elements Mg and Ca, which absorb sulfur, are added during production of the coating.

The alloy is applied direct to the base material of the component or to an intermediate layer having a third composition. Depending on the coating processes used, the layer thicknesses vary between 0.03 mm and 1.5 mm.

BRIEF DESCRIPTION OF THE DRAWINGS

The invention is explained with reference to the appended drawings, in which.

Only those elements which are pertinent to the invention are illustrated.

DETAILED DESCRIPTION OF THE PREFERRED EMBODIMENTS

The invention is explained in more detail on the basis of an exemplary embodiment, which describes the production of a coated gas turbine component or another component of a thermal turbomachine. The gas turbine component to be coated is made from an austenitic material, in particular a nickel superalloy. Before it is coated, the component is first chemically cleaned and then roughened using a blasting process. The component is coated under a vacuum, under shielding gas or in air by means of thermal spraying processes (LPPS, VPS, APS), high-velocity spraying (HVOF), electrochemical processes, physical/chemical vapor deposition (PVD, CVD) or another coating process which is known from the prior art.

An NiCrAlY alloy which, according to the invention, includes (% by weight) 23 to 27% by weight of chromium, 4 to 7% by weight of aluminum, 0.1 to 3% by weight of silicon, 0.1 to 3% weight of tantalum, 0.2 to 2% by weight of yttrium, 0.001 to 0.01% by weight of boron, 0.001 to 0.01% by weight of magnesium and 0.001 to 0.01% by weight of calcium, is used for the coating. The remainder of the alloy consists of nickel and inevitable impurities. It is preferable for the Al content to be in a range from over 5 up to 6% by weight. All the weight details are based on the total weight of the alloy used.

The alloy according to the invention has a significantly improved resistance to oxidation and corrosion compared to the known high-temperature protection layers. With the high-temperature protection layer according to the invention, it can be concluded that at high temperatures (above 800° C. depending on the particular embodiment) it includes at least 50% by volume of aluminum-containing γ and γ' phases, allowing the formation of a protection layer which contains aluminum oxide, while at low and medium temperatures (below 900° C. depending on the particular embodiment), it includes more than 5% of chromium-containing α-Cr phases, allowing the formation of a protection layer which contains chromium oxide.

Figure 1:
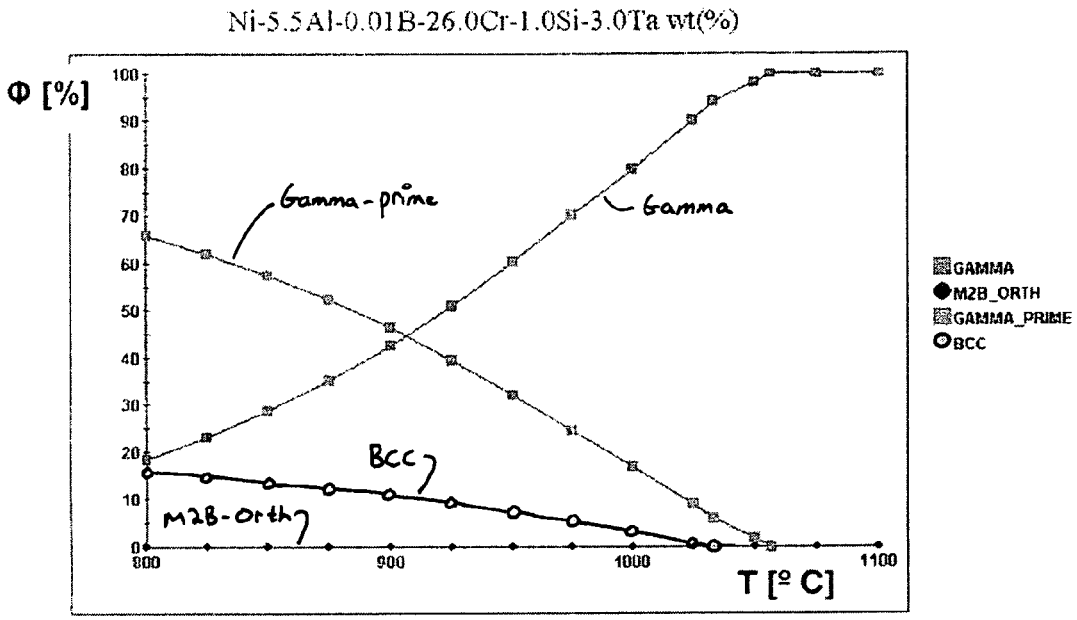
FIG. 1 shows the phase equilibrium (molar fraction Φ[%] vs temperature [° C.]) in accordance with the composition indicated here.
Figure 2:
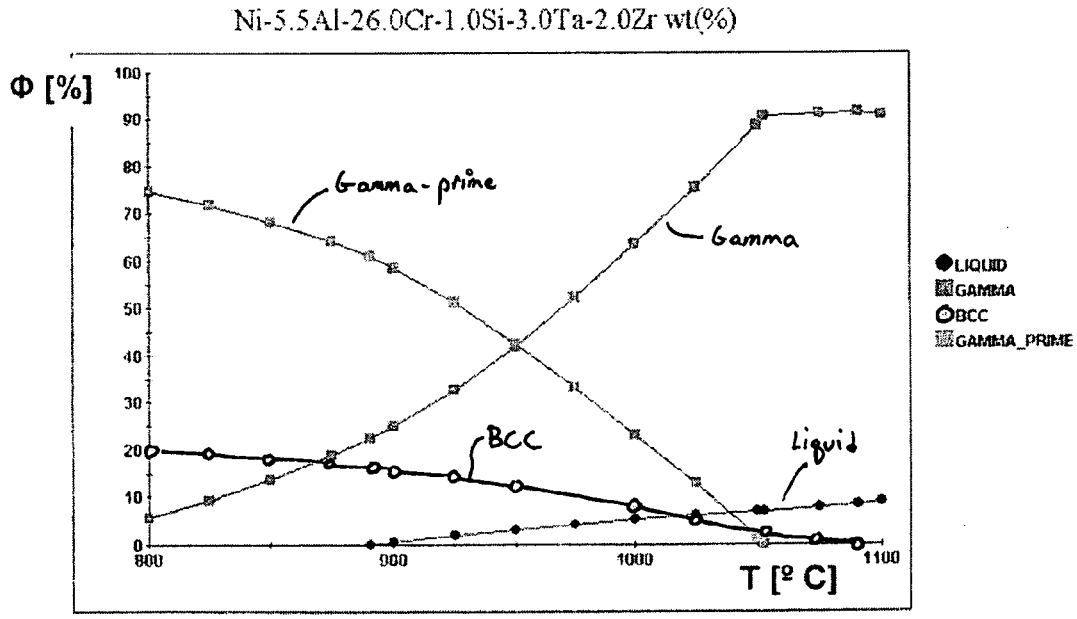
FIG. 2 shows the phase equilibrium (molar fraction Φ[%] vs temperature [° C.]) in accordance with the composition given in U.S. Pat. No. 4,973,445.

As can be seen from FIG. 1, the composition selected here includes little if any σ phase and/or β-NiAl phase or boride phases (denoted by M2B_ORTH in FIG. 1) by volume, and consequently significant advantages are to be expected in the event of fluctuating temperature loading. The comparison alloy (FIG. 2) has a similar composition in respect of some elements, but on account of the differences in other elements nevertheless has a very different microstructure, which our experience has shown will not have a sufficient ability to withstand temperature changes for use in a turbine and, moreover, cannot be used on account of incipient melting at over 900° C.

To improve the bonding of the covering layer, which contains aluminum oxide, at high temperature, silicon and boron are added to the alloy of the base material which forms the high-temperature protection layer. This increases the protection of the high-temperature protection layer and the component below it significantly.

The production-related, inherent sulfur impurity, which is typically present in a concentration of less than 10 ppm but in some cases may reach 50 ppm, leads to a reduced resistance to oxidation and corrosion. According to the invention, the trace elements Mg and Ca, which absorb sulfur, are added during production of the coating, thereby increasing the resistance to corrosion in the temperature range below 850 to 950° C.

The quantitative ratio of chromium to aluminum is restricted to from 3.6 to 6.5, in order to prevent the formation of brittle β phases. The quantitative ratio of nickel to chromium is restricted to from 2.3 to 3.0, in order to prevent the formation of brittle σ phases, and this improves the ability to withstand fluctuating temperatures.

The secure and stable bonding of the protection layer and its covering layer in the event of frequent temperature changes is achieved by means of the yttrium content, which is specifically stipulated for the alloy.

The material that forms the alloy is in powder form for thermal spraying processes and preferably has a grain size of from 5 to 90 μm. For the other processes mentioned above, the alloy is produced as a target or as a suspension. The alloy is applied direct to the base material of the component or to an intermediate layer consisting of a third composition. Depending on the coating processes, the layer thicknesses vary between 0.03 mm and 1.5 mm. After the alloy has been applied, the component is subjected to a heat treatment. This takes place at a temperature of from 1000 to 1200° C. for approximately 10 minutes to 24 hours.

While the invention has been described in detail with reference to preferred embodiments thereof, it will be apparent to one skilled in the art that various changes can be made, and equivalents employed, without departing from the scope of the invention. Each of the aforementioned documents is incorporated by reference herein in its entirety.

What is claimed is:

1. A high-temperature protection layer for a component, consisting of (% by weight): 23 to 27% Cr, 4 to 7% Al, 0.1 to 3% Si, 0.1 to 3% Ta, 0.2 to 2% Y, 0.001 to 0.01% B, 0.001 to 0.01% Mg, and 0.001 to 0.01% Ca, remainder Ni and inevitable impurities.

2. The high-temperature protection layer as claimed in claim 1, wherein the Al content is (% by weight) from 5% to 6%.

3. The high-temperature protection layer as claimed in claim 1, wherein the quantitative ratio of Cr to Al is in the range from 3.6 to 6.5.

4. The high-temperature protection layer as claimed in claim 1, wherein the quantitative ratio of Ni to Cr is in the range from 2.3 to 3.0.

5. The high-temperature protection layer as claimed in claim 1, comprising a γ (gamma) phase and a γ' (gamma prime) phase, and wherein the sum of the proportions by volume of the γ (gamma) and γ' (gamma prime) phases in the temperature range from 800° C. to 1050° C. is more than 50%.

6. The high-temperature protection layer as claimed in claim 1, comprising α-Cr phases, and wherein the proportion by volume of the α-Cr phases in the temperature range from 800° C. to 900° C. is more than 5%.

7. The high-temperature protection layer as claimed in claim 1, wherein the layer has a thickness of between 0.03 mm and 1.5 mm.

8. The high-temperature protection layer as claimed in claim 7, further comprising:

a base material of a component, or an intermediate layer; and wherein the layer is applied directly to the base material or to the intermediate layer.

9. A high-temperature protection layer comprising (% by weight): 23 to 27% Cr, 4 to 7% Al, 0.1 to 3% Si, 0.1 to 3% Ta, 0.2 to 2% Y, 0.001 to 0.01% B, 0.001 to 0.01% Mg, and 0.001 to 0.01% Ca, remainder Ni and inevitable impurities produced by a process selected from the group consisting of under a vacuum, under shielding gas, and in air by thermal spraying processes (LPPS, VPS, APS), high-velocity spraying (HVOF), electrochemical deposition, or physical/chemical vapor deposition (PVD, CVD).

10. A high-temperature protection layer comprising (% by weight): 23 to 27% Cr, 4 to 7% Al, 0.1 to 3% Si, 0.1 to 3% Ta, 0.2 to 2% Y, 0.001 to 0.01% B, 0.001 to 0.01% Mg, and 0.001 to 0.01% Ca, remainder Ni and inevitable impurities, configured and arranged to be a coating for components of thermal turbomachines.

11. A system comprising:

a thermal barrier coating and a bonding layer beneath the thermal barrier coating; and wherein the bonding layer comprises a high-temperature protection layer comprising (% by weight): 23 to 27% Cr, 4 to 7% Al, 0.1 to 3% Si, 0.1 to 3% Ta, 0.2 to 2% Y, 0.001 to 0.01% B, 0.001 to 0.01% Mg, and 0.001 to 0.01% Ca, remainder Ni and inevitable impurities.

* * * * *